United States Patent [19]

Peery et al.

[11] Patent Number: 4,944,060

[45] Date of Patent: Jul. 31, 1990

[54] MATTRESS ASSEMBLY FOR THE PREVENTION AND TREATMENT OF DECUBITUS ULCERS

[76] Inventors: John R. Peery, 2170 Princeton St., Palo Alto, Calif. 94306; Michael N. Gold, 6222 Mammoth Ave., Van Nuys, Calif. 91401; Saadia M. Schorr, 3390 Vista Haven Rd., Sherman Oaks, Calif. 91403; Jack Gorby, 525 N. Bellagio Ter., Los Angeles, Calif. 90049

[21] Appl. No.: 318,733

[22] Filed: Mar. 3, 1989

[51] Int. Cl.[5] ..... A47C 7/057; A47C 27/10

[52] U.S. Cl. ..... 5/453; 5/455; 5/469

[58] Field of Search ..... 5/453, 469, 449, 455, 5/454, 468, 60, 482, 461

[56] References Cited

U.S. PATENT DOCUMENTS

| | | | |
|---|---|---|---|
| 3,644,950 | 2/1972 | Lindsay, Jr. . | |
| 3,653,083 | 4/1972 | Lapidus . | |
| 3,822,425 | 7/1974 | Scales . | |
| 3,879,776 | 4/1975 | Solen . | |
| 4,193,149 | 3/1980 | Welch | 5/453 |
| 4,225,989 | 10/1980 | Corbett | 5/453 |
| 4,267,611 | 5/1981 | Agulnick | 5/453 |
| 4,391,009 | 7/1983 | Schild | 5/453 |
| 4,394,784 | 7/1983 | Swenson | 5/453 |
| 4,472,847 | 9/1984 | Gammons | 5/453 |
| 4,525,885 | 7/1985 | Hunt | 5/453 |
| 4,605,582 | 8/1986 | Sias et al. | 5/464 |
| 4,617,690 | 10/1986 | Grebe | 5/453 |
| 4,722,105 | 2/1988 | Douglas | 5/453 |
| 4,723,328 | 2/1988 | Kato | 5/453 |
| 4,745,647 | 5/1988 | Goodwin | 5/453 |

OTHER PUBLICATIONS

Sales Brochure: "FLEXICAIR II Low Airloss Therapy", 1988 Support Systems International, Inc.

Sales Brochure: "BioDyne II", Kinetic Concepts, Inc., 1/89.

*Primary Examiner*—Alexander Grosz

*Attorney, Agent, or Firm*—Lyon & Lyon

[57] ABSTRACT

A mattress assembly for the treatment and prevention of decubitus ulcers and for the treatment of other conditions of the skin and/or underlying tissue. The assembly includes a base support, mattress core disposed on the support and defining a plurality of discrete, air permeable, hydrophobic air cells, and a pair of lateral bolsters disposed adjacent the sides of the mattress core. A top sheet formed of an air and liquid permeable, highly elastic, low friction water wicking material is disposed over the core and bolsters to provide a planar support surface which readily conforms to the irregularities in the topography of the body of a person resting thereon without wrinkling so as to minimize the shear forces acting on the skin and draw moisture away from the skin. A pump or other suitable means is provided for directing air flow through a plurality of controllable valves to and through the cells of the mattress core and top sheet to inflate the cells for supporting a person thereon and maintaining the skin in a properly hydrated condition. A control assembly regulates the air pressure within individual or groups of cells to maintain the contact pressure of the mattress assembly against the skin of a person thereon at a desired level and to facilitate physician and nursing care.

45 Claims, 5 Drawing Sheets

MATTRESS ASSEMBLY FOR THE PREVENTION AND TREATMENT OF DECUBITUS ULCERS

BACKGROUND OF THE INVENTION

The present invention relates to a low cost air loss mattress assembly adapted for use with standard hospital bed frames and residential beds for the prevention and treatment of decubitus ulcers, also known as pressure sores or bed sores. While various mattress and bed assemblies have been previously developed and used for patients with decubitus ulcers or at decubitus risk, they generally require specially fabricated bed frames or extensive modifications to existing frames, are very costly, cumbersome, and extremely heavy, all of which have greatly restricted their availability and use. In addition, such devices often fail to satisfy all of the necessary needs which must be met to successfully prevent or treat decubitus ulcers.

Decubitus ulcers result from excessive force and pressure upon the skin over a prolonged period of time, and typically occur on bedridden patients who are limited partially or totally in their mobility. Such immobility occludes blood and interstitial fluid transport by prolonging pressure on the dermis, often at bony protuberances, which exceeds the pressure necessary to close capillaries. While exceeding such pressure for short periods of time is a routine and safe occurrence for active individuals, prolonged capillary closure reduces the oxygenation of tissues to a level that causes cell death in the underlying tissue, creating a decubitus ulcer.

The pressure on the skin necessary to effect capillary closure typically is only 32 mm. Hg. An average person of 150 pounds sitting in a chair, assuming even distribution of the load, generates a pressure of about 54 mm. Hg. on the skin in the buttock/thigh support area. Accordingly, it is almost physically impossible to support a typical adult in a seated position without exceeding the capillary closure pressure, because there is insufficient surface over which to distribute the load. However, a patient lying horizontally has enough surface area to distribute the load without generating peak pressures in excess of 32 mm. Hg., if the support surface is appropriately designed.

In addition to providing such low contact pressure in the prevention and treatment of decubitus ulcers, it is necessary to prevent skin maceration, to reduce the shear forces exerted by the support surface on the skin, and to prevent temperature extremes on the skin, as these conditions also contribute to the formation and worsening of decubitus ulcers. Conventional hospital bedding fails on all counts. It cannot accommodate a topographic prominence (bony protuberance) by deforming adequately at the site of the load and thus does not sufficiently distribute the load from the prominence to the surrounding region. High pressures at the prominence result, creating a severe risk of decubitus ulceration. The water impermeable bacteriocidal covers used on conventional hospital mattresses are not only inelastic, creating an excessive pressure buildup on bony protuberances, but hold moisture such as perspiration and urine in contact with the skin, which macerates and weakens the skin. Bacteriocidal covers may also trap heat and cause elevated skin temperature. Macerated skin is highly susceptible to damage from the shear forces which result when a person moves, is pulled across a bed surface, or when the person's bed pan, dressings or clothing is changed. Further, bacteria and viruses are harbored in the moisture held against the skin by these nonporous covers. Preventing or inhibiting normal evaporation of perspiration precludes normal cooling of the skin. When the dead or macerated skin is ruptured by the rubbing movement of the patient against the mattress or sheet or where the skin is already breached, the bacteria and viruses are able to enter the ruptured skin and cause local as well as systemic infections. Conventional mattress and bedding designs do not adequately reduce these shear forces. The coefficient of friction against skin of ordinary cotton or cotton/polyester sheets is sufficient to easily injure macerated skin.

Minimal skin contact pressure, moisture control, reduced shear forces and in some cases temperature control, must be provided in a mattress assembly which can effectively prevent and treat decubitus ulcers. For such an assembly to be readily accessible to the majority of patients at risk for decubitus ulcers or with existing decubitus ulcers, it is important that such a mattress assembly be relatively inexpensive, not unduly cumbersome or heavy, easily operable and adjustable and retrofitable to standard hospital bed frames and residential beds without extensive modification. While conventional hospital beds are readily accessible, they fail to meet the basic needs necessary to prevent or treat decubitus ulcers. A number of therapeutic beds have heretofore been developed to replace the standard hospital bed for such prevention or treatment. While some of those beds do provide reduced skin contact pressure and some provide somewhat improved moisture control under certain limited circumstances, they generally fail to address the problem of shear force, are very expensive, and cannot be readily retrofitted to standard hospital bed frames or residential beds. In addition, many are very cumbersome and extremely heavy, sometimes exceeding floor loading limits in some hospitals and in most nursing and residential homes as well as creating storage problems. Many of the therapeutic beds heretofore developed also create significant cleaning and/or sterilization problems, and often require an experienced technician to install, operate and adjust the beds properly to meet the patient's needs. Many of the beds can not meet several needs simultaneously, because the solution for one often defeats the effectiveness for others. As a result, access to such beds has been very limited, and decubitus ulcers continue to be a substantial problem with bedridden patients.

The mattress assembly of the present invention simultaneously fulfills each of the requirements necessary to prevent and treat decubitus ulcers. It provides the necessary support to maintain the contact pressure with the skin at a level below 32 mm. Hg., avoiding capillary closure and cell death in the skin and underlying tissue, the primary cause of decubitus ulcers. It draws moisture away from the skin, while directing a selective air flow through the mattress surface to the skin to maintain the skin in a properly hydrated condition, and significantly lowers the coefficient of friction between the skin and the mattress to reduce the damaging shear forces exerted on the skin. It also readily accommodates temperature control of the bed surface. The mattress assembly disclosed herein does not require a special bed frame, but can be readily retrofitted to existing hospital bed frames and residential beds, significantly reducing the cost of decubitus treatment and prevention, while substantially increasing its availability to those in need.

Much of the present mattress assembly can also be made disposable, obviating the need for repeated cleaning and sterilization and thus greatly reducing the chance of contaminating other patients as well as reducing the costs associated therewith. This later feature is of particular significance in treating persons afflicted with Acquired Immune Deficiency Syndrome. Further, much of the mattress assembly can also be easily cleaned while in service, can be laundered locally, or could be reprocessed in a centralized cleaning/repackaging facility when reuse is preferable to disposal. In addition to the treatment and prevention of decubitus ulcers, the mattress assembly disclosed herein is very useful for treating patients with burns, wounds, incisions, and other conditions of the skin and/or underlying tissue.

SUMMARY OF THE INVENTION

The present invention comprises a mattress assembly for use in the prevention and treatment of decubitus ulcers which is adapted to replace the conventional bacteriocidal mattress commonly used on standard hospital bed frames and is readily retrofitable for use on residential bed frames. The assembly includes a support base, a mattress core disposed on the base and constructed of a gas permeable, aqueous liquid impermeable material defining a plurality of discrete, air permeable, hydrophobic supporting air cells, and an adjustable source of high volume, low pressure air communicating with the interior of the supporting air cells for directing flow therethrough. The air flowing to and through the cells defines and controls the pressure both within individual cells and/or selected groups of cells to maintain the contact pressure of the mattress assembly against the skin of a person resting thereon below 32 mm Hg. (or other pressures as required for the situation), to facilitate handling and bed panning of a patient thereon, dressing changes, and to maintain the skin in a properly hydrated condition to prevent maceration thereof.

A pair of bolsters are longitudinally disposed along and adjacent the lateral sides of the mattress core for retaining the patient on the core, facilitating ingress and egress to the core and providing lateral seating surfaces. The side bolsters also preferably house the air valves and sensors, associated air conduits and electrical wiring, and provide a mounting surface co-planar with the upper surface of the mattress assembly for the attachment of physical restraints and orthopaedic devices. For certain applications, a second pair of bolsters may be disposed at the head and foot ends of the mattress core, between the side bolsters, to provide pressure reduction for the head and feet of the patient when the bed is in an inclined (such as Trendelenburg or reverse Trendelenburg) or otherwise articulated position which tends to force the patient's head or feet against the headboard or footboard of the bed frame.

A washable and disposable top sheet is disposed over and about the upper surface of the mattress core and bolsters. The top sheet is constructed of an air and liquid permeable, highly elastic, and water wicking material having a low coefficient of friction. The top sheet stretches and conforms to bony protuberances at low tensile stresses without wrinkling so as to provide the upper surface of the mattress assembly with a planar upper surface which possesses a low coefficient of friction with skin and clothing, which minimizes the shear forces acting on the skin, and which draws liquid away from the skin.

A control module is provided to control the pressure in individual cells and/or groups of cells and to permit selection of preset control values for the regulation of innercell pressures. A removable fluid impermeable liner is preferably disposed under and about the sides of the mattress core for containing fluids and contaminants therein, and means are preferably provided for regulating the temperature of the air flowing through the supporting cells to prevent undesirable temperature extremes on the skin.

The interior or exterior upper surfaces of the supporting air cells defined by the mattress core are preferably differentially coated with multi-directional grids of an elastomer or polymeric material to restrict air passage through the cells only to those zones which will be in proximity with the patient resting thereon thereby reducing the pump capacity necessary to provide the required air flow, dampening the noise created by wrinkling and folding of the cell material, and increasing the tensile strength of the cell material.

It is the principal object of the present invention to provide an improved mattress assembly for the prevention and treatment of decubitus ulcers which is useable on conventional hospital bed frames and residential beds and which maintains the contact pressure on the skin of a person resting thereon at or below 32 mm. Hg., maintains the skin in a properly hydrated condition, and minimizes the shear forces exerted on the skin as a person moves or is moved on the mattress assembly.

It is another object of the present invention to provide a mattress assembly for the prevention and treatment of decubitus ulcers which employs regulated zone-tailored air flow therethrough to particular anatomical sites to maintain the skin of a person resting thereon in a properly hydrated condition and with minimal air pump capacity requirements.

It is a further object of the present invention to provide a mattress assembly for the prevention and treatment of decubitus ulcers which contains a comfortable, wrinkle free, washable or disposable, and air and liquid permeable top sheet having a low coefficient of friction which readily stretches over bony protuberances without buildup of contact pressure on the skin of a person resting thereon.

It is yet another object of the present invention to provide a mattress assembly for the prevention and treatment of decubitus ulcers which contains a comfortable, wrinkle free, washable or disposable, and air and liquid permeable top sheet having a low coefficient of friction which draws excess moisture away from the skin of a person resting thereon to prevent maceration of the skin.

It is another object of the present invention to provide a mattress assembly for the prevention and treatment of decubitus ulcers which can provide temperature control for regulating the heat flux to and away from the skin surface in contact with the mattress surface.

It is another object of the present invention to provide a mattress assembly for the prevention and treatment of decubitus ulcers which includes selective area pressure regulation for controlling the pressure of the patient's skin upon the mattress to maintain fixed, preselected pressure values or for controlling the pressure to follow a program of pressure set-point values which vary with time (for massage or enhancement of circulation), and for facilitating handling, dressing changes, and bed panning of a patient thereon.

It is another object of the present invention to provide a mattress assembly for the prevention and treatment of decubitus ulcers which employs a multi-celled air loss support core and includes a control module to permit selection of preset control values for the intercell pressures to facilitate maintenance of minimal contact pressures between the patient's skin and the mattress.

It is yet another object of the present invention to provide a mattress assembly for the prevention and treatment of decubitus ulcers which is light in weight so as not to exceed floor loading capacities of residential or nursing homes or hospital buildings.

It is another object of the present invention to provide a mattress assembly for the prevention and treatment of decubitus ulcers which is of a modular construction to facilitate installation, service and cleaning and reduce the cost of parts replacement.

It is a further object of the present invention to provide a mattress assembly for the prevention and treatment of decubitus ulcers which is economical to manufacture and readily operated to reduce nursing labor and minimize training to qualified users.

It is a still further object of the present invention to provide a mattress assembly for the prevention and treatment of decubitus ulcers which, when desireable, employs a disposable core and/or top sheet to obviate the need for periodic cleaning and/or sterilization and reduce the chance of contaminating subsequent users.

These and other objects and advantages of the present invention will become apparent from the following detailed description taken in conjunction with the accompanying drawings.

IN THE DRAWINGS

DESCRIPTION OF THE PREFERRED EMBODIMENT

Figure 1:
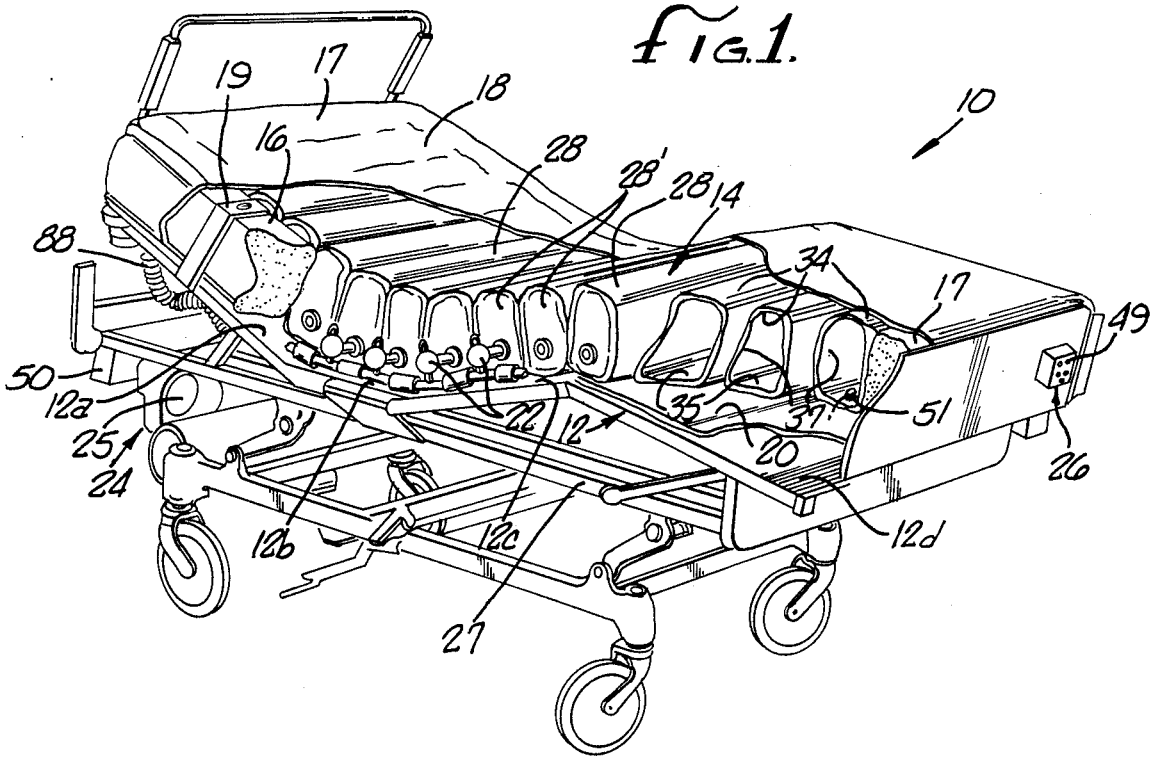
FIG. 1 is a perspective view of the mattress assembly of the present invention installed on a standard hospital bed frame.

Referring now in detail to the drawings, the mattress assembly 10 of the present invention includes a base support 12, an air supported cellular mattress core 14, lateral support side bolsters 16, a highly elastic, water wicking and air and liquid permeable top sheet 18, a fluid impermeable lower liner 20, a plurality of air valves 22, air pump 24, air filter 25 and a control module 26. The base support 12 rests directly on a standard residential or hospital bed frame 27 with the mattress core 14 and lateral bolsters 16 being carried by base support 12. When used on a hospital or other bed frame which allows for articulation of the mattress assembly, such as that illustrated in FIG. 1, head and foot transverse bolsters 17 are also preferably provided. Lower liner 20 rests directly on base support 12 and extends between support 12, lateral side bolsters 16, transverse bolster 17 (if utilized) and core 14 to isolate the core 14 from the base support and bolsters.

The base support 12 is preferably constructed of a rigid and lightweight material, such as aluminum or a fiberpolymer composite. As seen in FIG. 1, base support 12 is segmented into four pivotally joined sections **12*a*–12*d*, corresponding to the frame elements of a standard hospital bed frame 27, so as to permit normal articulation of the bed frame. Base support 12 provides an unyielding support surface for performing cardio pulmonary resuscitation (CPR) and a securement surface for the lateral side bolsters 16 and transverse bolsters (if utilized). If CPR capability were not desired or if the bed frame itself has a rigid top surface, a heavy flexible film of polyester or similar fabric (not shown) could be employed in lieu of base support 12 to provide a flexible connecting foundation between lateral bolsters 16**.

The mattress core 14 defines a plurality of discrete, transversely disposed, pressure controlled air cells 28. Air cells 28 are constructed of an air and water vapor permeable and aqueous liquid impermeable material such as that marketed by Standard Textile Company, Inc. under the trademark ComPel, or the material marketed under the trademark TYVEK by E.I. DuPont. Such materials are low in cost, easily fabricated, provide a partial or complete barrier to the passage of the bacteria through the cell surface, and render cells 28 hydrophobic, yet permeable to air and water vapor to allow air loss therethrough for drying of moisture trapped between the patient and the bed surface to prevent skin maceration which can lead to decubitus ulceration. Of these two materials, ComPel which is a relatively inexpensive woven material for its features, is preferred because of its softness and resistance to wrinkling, and because it is relatively noise-free when handled. TYVEK, on the other hand, is a non-woven spun bonded material which, while being less expensive then ComPel, is somewhat paper-like in that folding, bending and deflecting TYVEK generates wrinkling and crackling sounds similar to that of rustling and folding papers. TYVEK is also not as soft as ComPel and is more prone to wrinkling. Each of these materials, however, possesses the physical properties of being air and water vapor permeable and liquid impermeable, which are desireable for the structure of cells 28. The material marketed under the trademark DUON by Phillips Petroleum is a nonwoven material composed of a staked-fiber mat, which is softer, quieter and more expensive than TYVEK, but not as soft or quiet as ComPel and somewhat less expensive. DUON itself is not liquid impermeable but could be laminated to TYVEK or another liquid impermeable material to obtain a liquid impermeable laminate having the desireable properties of each material. A laminate with Duon could have added softness, acoustic dampening, strength and wrinkle resistance. As will be described, air cells 28 are serially communicated with air pump 24 by means of valves 22 for the continuous passage of high volume, low pressure air into and through the air permeable cells to distribute the load of a person thereon over the body without exceeding the capillary closure pressure of 32 mm Hg. to maintain the skin in a properly hydrated condition and to transport heat in the circulating air by forced convection to optimally maintain the skin temperature within a selected range. When inflated, each cell 28 is preferably about 10–13 in. high, 3–6 in. deep (measured in the direction parallel to the major axis of the mattress assembly), and about 32 in. across. It should be noted that particular special shapes of each cell 28 can be optionally provided to accommodate specific anatomical sites or for other special purposes. For example, the top surface of a cell 28 could define two depressions adapted to receive a patient's calves or a single depression sized to receive the backside of one's head.

The interior or exterior upper surfaces 34 of cells 28 are preferably differentially coated with multi-directional grids 36 of an elastomer or polymer material or other suitable material to selectively restrict air passage therethrough. The lateral side walls and lower surfaces 35 and 37 of cells 28 are coated preferably with an air impermeable thermoplastic heat seal or other coating to prevent air loss therethrough and thereby cause the air passing through cells 28 to pass only through the areas in the upper surfaces 34 thereof not sealed by grids 36. As only particular anatomical sites (e.g., sacrum, ischial tuberosities, occiput, and heels) are at severe risk of decubitus ulceration, air flow may be selectively and preferentially directed by means of grids 36 to areas most in need of maceration prevention or temperature control or to effect evaporation of fluids which have passed through the aqueous liquid permeable top sheet 18. Any aqueous fluids collecting between the cells 28 on the lower liner 20 may be periodically wiped up, the surfaces disinfected, and lingering traces of fluids allowed to evaporate. By sealing all but the upper surface 34 of air cells 28 and configuring grids 36 so as to direct or tailor the flow of air primarily to at-risk zones, the total air consumption of the bed is reduced greatly, permitting the use of a smaller air pump than is required with prior art air loss beds where air permeability is uniform across the entire surface of the core or cells. By optionally leaving unsealed spots or areas at the bottom edge of the cells where the sides of adjacent cells meet and small spots or areas in the side walls of the cells, one can effect evaporation of fluids and exudates which collect at the bottom of the cells and between adjacent cells walls after passing through the top sheet 18 without significantly increasing the total air flow. The use of a smaller air pump results in a reduction of noise, capital and operating expenses, and the size of the mattress system. Each cell can be provided with its own grid pattern to accommodate specific anatomical sites or for other special purposes such as for burn victims where additional air flow might need to be directed to particular sites.

While the mattress core 14 and cells 28 are relatively soft if constructed of the preferred ComPel brand material, if a less expensive spun-bonded material, such as TYVEK, is used for the construction of the core and cells to further reduce the cost of assembly, acoustic damping may become desireable as a result of the crinkling and crackling sounds which such materials which resemble paper in this property, make when folded, bent or deflected. Such materials, which resemble paper in this property, are typically stiff and yield suddenly when bent or deflected. This sudden yielding generates sounds which the stiff material then transmits over its surface and radiates noise into the surrounding air. Grids 36, in addition to limiting the air flow to particular anatomical sites, accomplish acoustic property control for such materials as well. The grids' intimate bonding with the spun-bonded material links their mechanical dynamic behaviors, and thus their acoustical properties. Sufficient coating thickness is accumulated or applied in the formation of the patterns of grids 36 to dampen the paper-like noises that might otherwise result from normal body movement while lying on or sleeping on the mattress assembly 10. Further, grids 36, if properly configured, can significantly enhance the tensile strength of the cell material to prevent tears which might otherwise occur under some circumstances. The grids, with their elastic recovery, additionally inhibit wrinkling.

Figure 2:
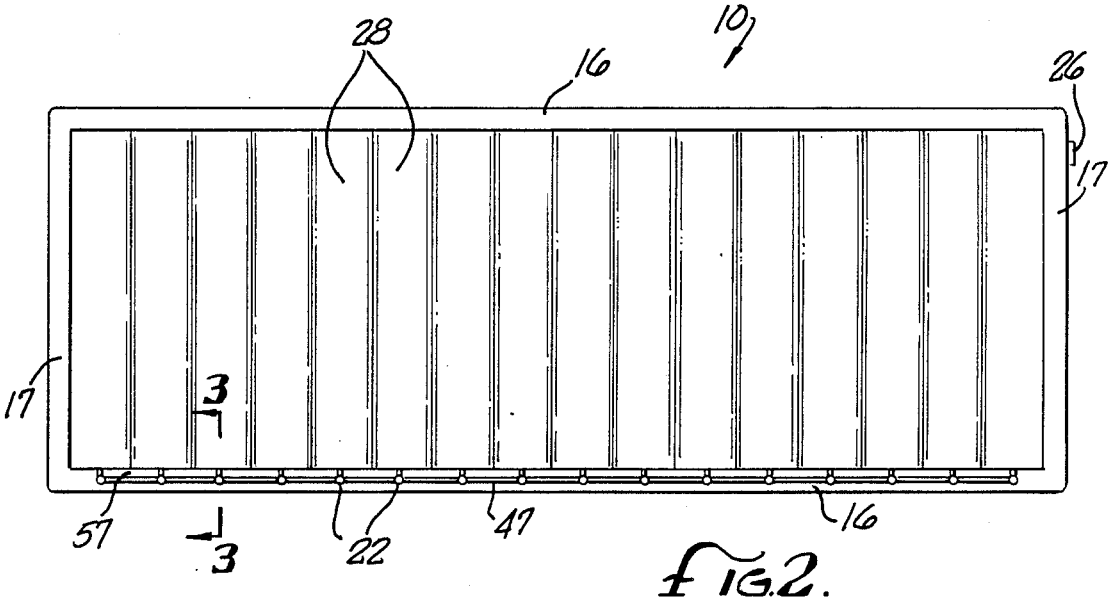
FIG. 2 is a top view of the mattress core and lateral bolsters of the present invention with a portion of one of the lateral bolsters broken away to illustrate the air valves and air lines.
Figure 4A:
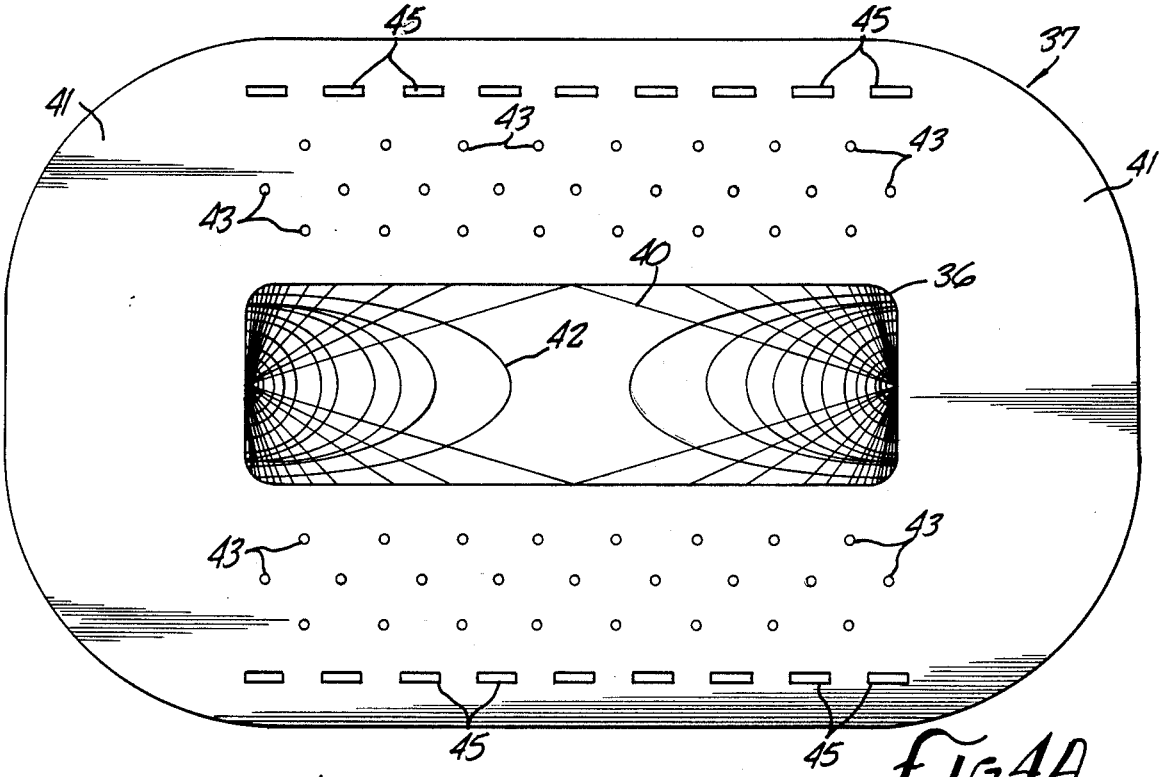
FIG. 4A is a top view of an individual cell illustrating one embodiment of the flow-tailoring web pattern thereon.
Figure 4B:
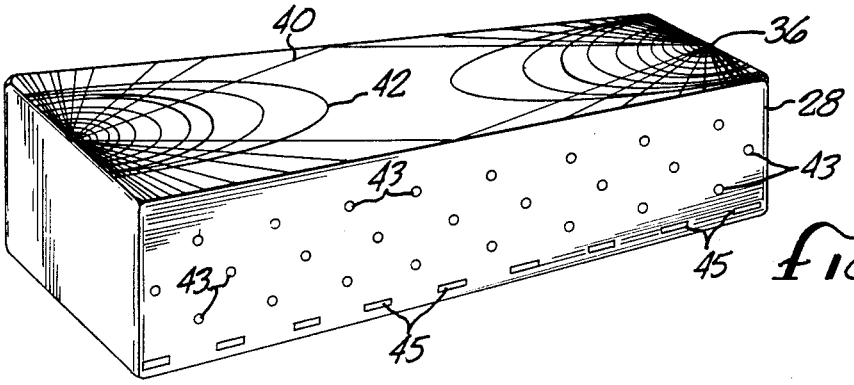
FIG. 4B is a perspective view of an individual cell illustrating the web embodiment of FIG. 4A thereon.

To achieve the desired zone-tailored air flow and noise dampening and increase the tensile strength of mattress core 14, grids 36 are preferably defined by a plurality of intersecting lines such as radially extending lines 40 and superimposed concentric oval or semi-oval lines 42 as seen in FIGS. 4A and 4B. FIG. 4A illustrates a length 37 of coated cell material prior to forming the material into a generally rectangular cell configuration, schematically represented in FIG. 4B. As seen in FIG. 4A, the central portion of the length 37 of material is provided with a centrally disposed grid 36 comprised of radial lines 40 and semi-oval lines 42. The portion 41 of the length of material surrounding grid 36 is coated with an air impermeable seal or coating as described earlier herein, while the previously discussed optional spots 43 and areas 45 in the coated portion 41 are left uncoated to effect fluid evaporation at the bottom of the subsequently formed cells 28 and between adjacent cells 28. As an alternative or in addition to employing the unsealed spots 43 and/or areas 45, auxiliary air lines 57 could be employed between adjacent cells 28 at or near the bottom thereof to direct evaporative air between the cells. Such lines would preferably extend the length of the cells and communicate with the main air line 47 as illustrated in FIG. 2 wherein one such line is schematically represented. Each line 57 would define a number of small apertures along the length thereof to provide the desired air flow between and along the entire lengths of the cells.

Figure 8:
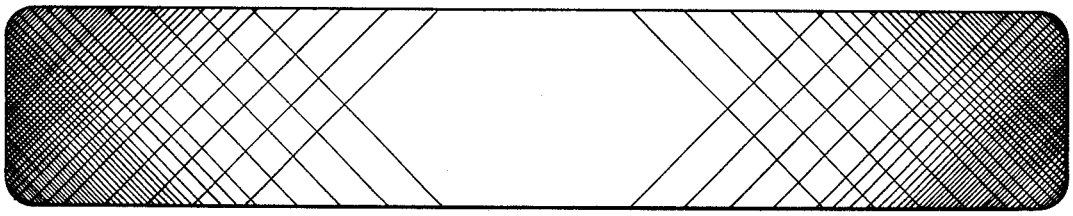
FIG. 8 is a top view of an individual cell illustrating an alternate embodiment of the flow-tailoring web pattern thereon.
Figure 9:
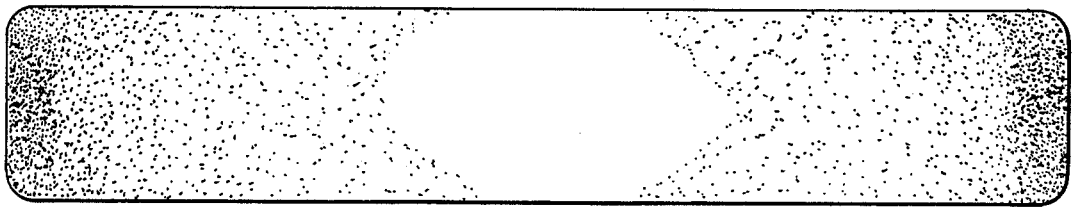
FIG. 9 is a top view of an individual cell illustrating another embodiment of the flow-tailoring web pattern thereon.

In addition to the grid pattern above described, other lined grid patterns could readily be employed such as perpendicular or oblique crosshatching, (FIG. 8), circles polygons (e.g. triangles, squares, pentagons, hexagons, etc.) or parallel lines. In addition, a grid pattern comprised of a plurality of differently sized and/or spaced dots could be utilized, as illustrated in FIG. 9. In the high risk areas of patient support, the grid pattern is less dense to focus more of the air flow therethrough, while in the low risk areas and toward the end portions of the cells, the patterns become more dense as the need of air loss through the cells in those areas decreases or becomes non-existent. Grids 36 can be applied to cell surfaces 34 by printing, silk-screening, spraying or other suitable process and are preferably formed of a thermoplastic elastomer such as polyurethane, a thermoset elastomer or a low modulus thermoplastic polymer such as polyethylene or ethylene vinyl acetate, a visco-elastic adhesive, a wax, a hot-melt adhesive or a milled or otherwise processed blend of all or some of the above. Grids 36 can be formed of a single application of one of the above or by a buildup of successive layers of one or more of the above materials.

Figure 10:
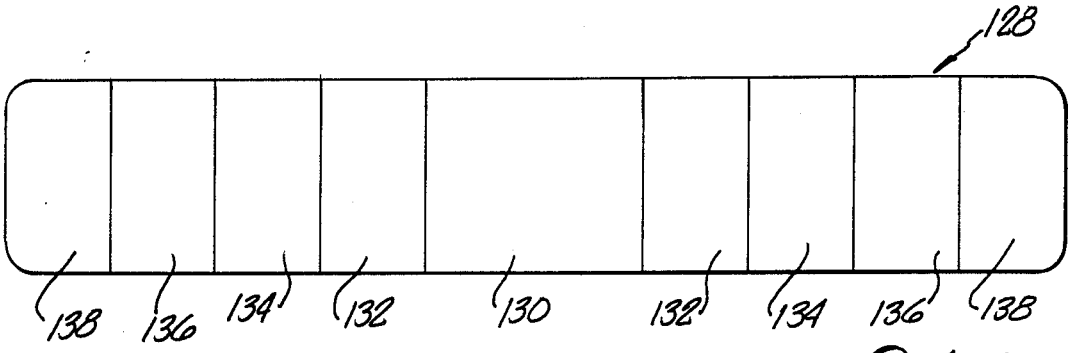
FIG. 10 is a top view of an individual cell illustrating another embodiment constructed of a plurality of panels that have different permeabilities.

In an alternative embodiment of the mattress cell, illustrated in FIG. 10, the cells 128 are constructed of a plurality of panels 130 which are generally orientated such that the major axis of each panel is perpendicular to the major axis of the cell. The panels are constructed of materials which have different air permeabilities to achieve the zone tailoring of the air flow provided by grids 36. The difference in the air permeabilities between the panels can be achieved, for example, by varying the density of a single material or by varying the materials used in the different panels. TYVEK, for example, is manufactured in different grades of permeability. FIG. 10 represents a cell 128 of this alternate embodiment wherein central panel 130 has the highest air permeability, panels 132 are less air permeable than panel 130, panels 134 are less air permeable than panels 132, panels 136 are even less air permeable, and end panels 138 have the lowest air permeability of the panels in the cell. If acoustic damping or further tailoring of the air flow is needed, a grid 36 could also be employed.

In addition to providing a relatively quiet, zone tailored air flow with an inexpensive material, the aforesaid configuration greatly reduces the cost of fabrication. Cells 28 can be formed in a continuous fashion on standard film conversion equipment through the sequential steps of printing, coating, die cutting, and heat sealing. Roll stock of TYVEK or similar material is fed into the film line. The polymer or elastomer (or blend thereof) is printed and/or coated in the pattern described above. Multiple coating stations or printing stations may be present on the line to utilize different polymers or elastomers for air flow control and acoustic damping. As for example, a low-modulus latex could be used for acoustic damping and a high-modulus polyurethane could be used for enhanced tensile strength and tear resistance. A thermoplastic heat seal coating or gasket forming layer then is placed around the perimeter of grids 36. After the coating stations, the TYVEK or other web is fed to the die cutting station(s). Typically, single cut sections of the web are used to make each cell, although longer sections of the printed and coated web could be utilized to form the entire mattress core 14.

The advantage of individual discrete cells 28, as seen in FIG. 1, as opposed to forming the mattress core 14 and cells 28 from a single sheet of material, is that the cells could be replaced on an individual basis should they become damaged or should special shapes or grid patterns be desired at any given location. On the other hand, by forming the cells from a single sheet of material, the cost of construction may be reduced. In either case, by registering the pattern of web coatings with the cut outline of the material of each cell, the zone-specific properties of the cells (or types of cells, as different density and/or strength grid profiles may be combined in a single bed) are retained in the final product.

When individual cut sections of the web are used to make a single cell, the sections are then fed to a heat sealing station where valve connector stems 46 (to be discussed) are welded directly to the thermoplastic heat seal coating or clamped to the cell material to achieve a compression seal against the gasket layer of the cell coating. The material is then folded into the shape of the cell and the cells are heat-seal welded or folded and clamped to effect a compression seal to form the cell 28. The cells could also be glued or sewn if desired. The individually formed cells would then be placed on or attached to the fluid impermeable lower liner 20 and communicated with the valves 22 in the manner to be described. Such cell construction represents a substantial improvement over the use of GORE-TEX in air loss beds which is very expensive, requires sewing techniques for assembly and fabrication, and is uniformly air permeable, and thus does not derive the substantial benefits resulting from zone-tailored air flow.

For certain applications such as heavy duty use or orthopedic rehabilitation, or to monitor locally the pressure being exerted against the skin, the above described core configuration can be enhanced with additional strengthening materials, noise dampers or sensors (pressure and motion), without significantly increasing the cost of construction. For example, conventional fabric may be laminated to the above described web to achieve improved acoustic dampening and perceived softness. In such case, the sealing coating would be applied over the top of the additional laminate, which additional laminate in turn preferably would be laminated to the interior surface of the other layer core material. Alternatively, a mesh of high permeability and tensile strength material, such as nylon or polyester, could be laminated to the spun-bonded polyolefin or other base material either at the same time the cell material is fabricated and dye cut, or at a later time. Again, a second application of a heat seal or gasket coating after lamination would be applied to permit cell fabrication by clamping or heat sealing. Sewing could also be utilized as a method of cell fabrication. If sewing were employed for cell fabrication, a gasket coating would only need to be used if the sewing did not provide a sufficiently air tight seal. If further noise damping or additional strength became desireable when using a material such as TYVEK, beyond that provided by grids 36, it could be achieved by laminating a thicker and softer layer of air and water vapor permeable material (not shown) such as DUON or SUPAC (a trademark of Phillips Petroleum) to the mattress core material. Grids 36 may be used as the means for securing the additional material by disposing the grids between the outer core material and the additional noise damping and strengthening inner layer, provided grids 36 were comprised of a polymer, elastomer, or other material that adheres to both layers. Alternatively, the grid material may be applied so as to physically envelop the fibers of both layers of material and thus effect attachment of one layer to the other as well as occlusion of reduction of air flow in the grid region.

Lateral support bolsters 16 constructed of a relatively dense foam material such as polyester, polyurethane, or similar foamed material are disposed adjacent the lateral sides of the mattress core 14. Lateral bolsters 16 could also be constructed of a flexible skeletal foundation of plastic or metal covered or topped with a layer of foam or other suitable construction. Bolsters 16 are affixed to base support 12 by bolt members, hook and pile fasteners or other suitable fastening means, and with base support 12, define a housing for the mattress core. If a fabric base were employed in lieu of base support 12 where an unyielding surface was not needed, lateral bolsters 16 would preferably be removeably attached or glued to the fabric base. The lateral bolsters 16 also facilitate ingress and egress to the mattress core 14, and provide lateral seating support for the mattress assembly 10. In addition, bolsters 16 help to center the patient on the mattress core and thereby reduce the reliance on conventional lateral restraining rails typically found in bed frames which are cumbersome and can often result in a patient or a patient's appendage becoming wedged between the mattress or bedframe and the rail, creating excessive pressure on the skin and increasing the risk of decubitus ulceration, as well as increasing the risk of other injury.

Figure 5A:
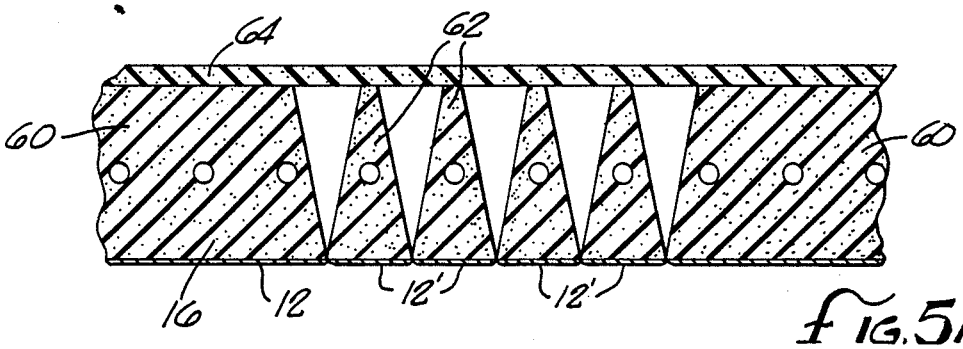
FIG. 5A is a sectional view of the embodiment of a lateral bolster.
Figure 5B:
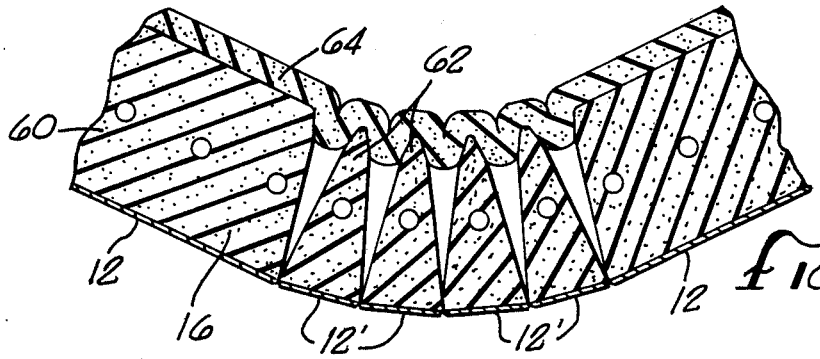
FIG. 5B is a sectional view of one embodiment of lateral bolster illustrating the articulation thereof.

To accommodate the normal articulation of standard hospital bed frames, lateral bolsters 16 are constructed so that they can bend to conform to such articulation. FIGS. 5A and 5B illustrate one embodiment of such construction. As seen therein, the base support 12 to which the bolsters 16, are secured, is modified in the areas of bending between the rigid sections thereof, to include a plurality of pivotally joined narrow tranverse sections 12'. Lateral bolsters 16 are each comprised of extended foam portions 60 which are disposed over the rigid sections **12*a*–12*d* of the base support 12, a plurality of narrow tapered foam sections 62 in the areas where bending occurs, between portions 60, and an upper foam cap 64 extending the length of the bolster. One of the tapered sections 62 is disposed over each of the narrow sections 12' of the base support so as to allow the bolster to bend as seen in FIG. 5**B and thereby accommodate the articulation of the bed frame.

Figure 6A:
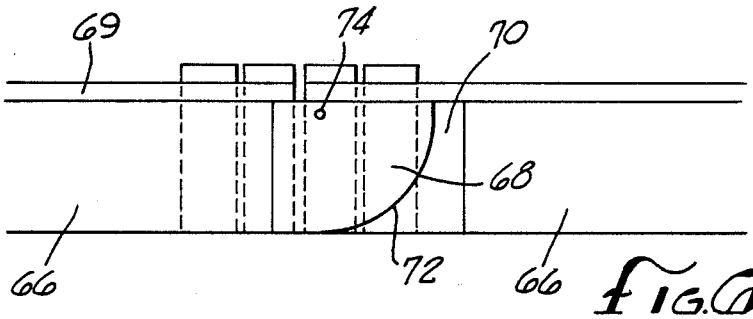
FIG. 6A is a side view of a second embodiment of a lateral bolster.
Figure 6B:
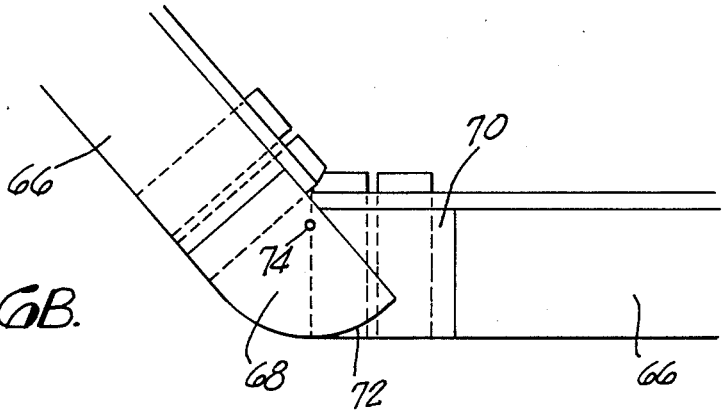
FIG. 6B is a side view of a second embodiment of a lateral bolster illustrating the articulation thereof.

A second embodiment of the lateral bolster is seen in FIGS. 6A and 6B. In this embodiment, the bolsters 66 are again preferably formed of polymeric foam and include a foam cap 69, but are provided with metal or plastic end caps 68 and 70 at each desired pivot point. End cap 68 has a curvalinear lower surface 72, overlaps end cap 70 and is pivotally secured thereto by a pivot pin 74. Such an embodiment would not require the modification of the base support 12 necessary for use with the embodiment of the bolster illustrated in FIGS. 5A and 5B.

If desired, additional transverse bolsters 17 of similar construction to lateral bolsters 16 but without the bending capability could be provided at the head and foot ends of the mattress assembly as shown in FIG. 1. Bolsters 17 would provide a cushion for the feet or the head in the event one were to slide toward the foot end or the head end of the bed when the bed was in an articulated or inclined configuration and could also assist in holding the lateral bolsters 16 in place. While side bolsters 16 are preferably co-planar, or close to co-planar with the core 14, the head and/or foot bolsters 17, if desired, could extend about eight inches above the core 14 to provide the desired support for a patient's head and/or feet.

In addition to serving the aforesaid purposes, bolsters 16 and 17 also could be used to provide anchors 19 for patient restraints, orthopaedic devices or other attachments (not shown). As the upper surfaces of the bolsters 16 are substantially coplanar with the surface of the mattress core 14, pulling on patient restraints anchored at the upper bolster surfaces would tend to pull inwardly on the bolsters as opposed to pulling the patient downwardly as occurs with conventional restraints anchored to the bed frame below the bed surface. Anchors 19 would thus reduce the pressure which would otherwise be exerted by the mattress assembly against the skin of a patient pulling against the restraints. Anchors 19 can extend upwardly through the base support 12 and bolsters 17 and/or 16 or could comprise brackets mounted adjacent the exterior surface of the bolsters, secured either to the base support and bolsters or to the bed frame and provide restraint attachment means coplanar with the upper surfaces of the bolsters. It should be noted that anchors 19 do not preclude the use of standard patient restraint and orthopedic traction and support accessories which typically attach to standard bed frames.

Cells 28 are pumped with a high volume of low pressure air to replenish the air that is purposely diffused through the cells into the top sheet 18 and against the patient's skin in contact with the mattress surface. The pressure requirements will vary with the weight of the person resting on the mattress assembly and the position of the person. Typically from about 0.2 to 2.0 psi within the cells is all that is required. Such air is provided by a suitable source 24 such as a positive displacement air pump, blower, turbine or compressor. The pump or other source 24 is preferably quiet in operation and has a capacity of about 250–1500 liters per minute. Air source 24 is detachably mounted on the underside of bed frame 27 or can rest below the bed frame on the floor and communicates with air cells 28 through air line 47 and a series of dedicated pressurized air or electrically operated valves 22. If a central source of air of suitable volume were available as a utility of the hospital building, the mattress assembly of this invention could alternatively be connected to the building supply with a suitable conduit and operated otherwise in the same manner as with the bed frame mounted air pump 24.

Figure 3:
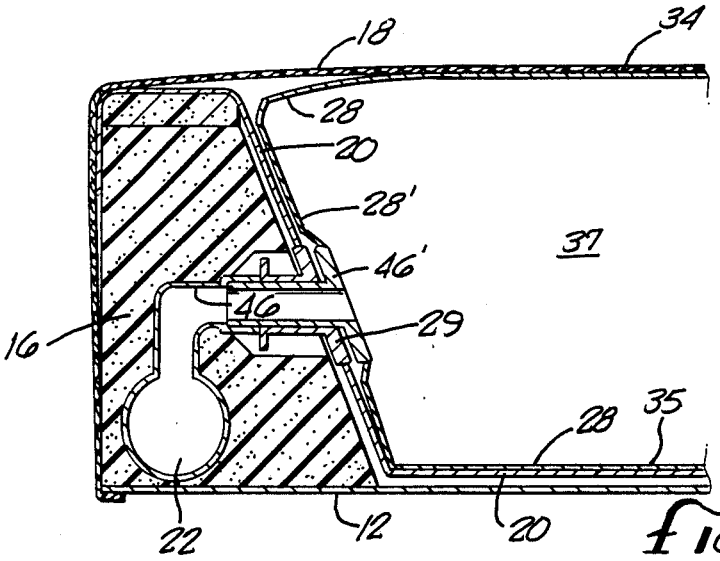
FIG. 3 is an enlarged sectional view taken along line 3—3 in FIG. 2.

Air line 47 and valves 22 are preferably mounted within one of the lateral foam bolsters 16, and valves 22 communicate with common ends 28' of air cells 28 by means of a corresponding plurality of valve connector stems 46. It should be noted, however, that valves 22 for adjacent cells 28 could be alternately mounted within opposite side bolsters 16 as opposed to all such valves 22 being mounted in a side single bolster. Such an arrangement might prove desireable if space for the valves and air lines in a single bolster were inadequate in a particular design. In such a case, either the head or foot bolster 17 could form a conduit from one side bolster to the other and house the air line or lines extending therebetween. As seen in FIG. 3, the valve stems 46 are each carried by and affixed to the end 28' of an air cell 28 by means of an annular end flange 46' and project outwardly therefrom to the valve 22 through and in sealing with a grommet 29 secured to the lower liner 20. The securement of common ends 28' of cells 28 to valves 22 through valve stems 46 secures ends 28' of the cells in place on the lower liner 20. While this securement should be sufficient to hold the mattress core 14 in place if the core 14 and thus cells 28 are formed from a single sheet of material, if the cells are formed individually, it could be desireable to provide additional means for removeably securing the ends of the individual cell remote from ends 28' to the lower liner 20 to properly secure the cells in place. This could be accomplished through the use of hook and pile fasteners such as Velcro which would be secured to the lower exterior surface of the cells at their remote ends and to the upper surface of liner 20. As an alternative or additional means of securing the cells at their ends remote from ends 28', nonfunctional (non-air communicating) valve stems, such as connector stems 46, could be employed to detachably secure the remote ends of the cells to fittings (not shown) secured to the liner 20, similar to the manner in which the air communicating valve stems 46 secure the ends 28' of the cells to valves 22. Such securements would allow the individual cells to be easily replaced on an individual basis as needed.

By serially communicating valves 22 with pump 24 selective pressure regulation for individual air cells 28 or selected groups of cells is achieved whereby the contact pressure of the patient's skin upon all areas of the mattress surface can be continuously maintained and regulated. Pressure sensors 48 are provided, preferably in valves 22, or in the valve connection stem 46, for the monitoring of the air pressure within each air cell 28 of the mattress core 14. An air filter 25 is preferably provided for filtering the air flow to or from pump 24 to remove contaminates which would otherwise tend to clog the interstices in the air cells 28 and interfere with air flow therethrough. If desired, a bacterial filter (not shown) could also be utilized to purify the air passing to the patient's skin. Also, if desired, a humidifier or dehumidifier could be placed in series with the air supply pump 24.

To prevent the undesirable rise or drop in skin temperature, a temperature control module 50 is preferably provided in series with pump 24 to heat or cool the air flow through the mattress assembly. Module 50 would be operatively connected to temperature sensors 51 located in the air flow, as for example on the interior surface of the air cells 28. As heating of the air flow would typically be required far more often than cooling, to reduce the cost of module 50, cooling could be achieved very economically by merely periodically increasing the air flow through the mattress core. As increased air flow would also increase pressure, the cooling flow should not be continuous. In those rare cases where cooling would be frequently required, module 50 could be an air conditioner or an additional air cooling module could be added. Heating of the air flow could easily be accomplished in module 50 through the use of a resistive heating element or by blending air drawn over the pump 24 with room air, as pump 24 gives off heat during operation and is thus a source of free heat which would otherwise be wasted.

The fluid impervious lower liner 20 is preferably constructed of a fabric such as heavy gauge TYVEK (providing a disposable liner 20), or such as nylon or polyester coated with a polymer such as polyurethane to render the liner impermeable (providing a reusable liner 20). The liner 20 is disposed under and about the mattress core 14 and between the core and bolsters 16 and 17 (if utilized) for containing fluids and contaminants on the core and top sheet 18 and preventing any such fluids and contaminants from contaminating the bolsters, valves, base, air source, bed frame, hospital room, etc. In addition, liner 20 can be used to gather the top sheet, mattress core and any such fluids and contaminants for disposal or cleaning to reduce the chance of contaminating the surrounding area or other assembly components.

A microprocessor-based control module 26 can be provided to permit selection of preset control values for the intracell pressures. By selecting from preprogrammed modes, certain cells or groups of cells 28 may be inflated to their ideal height or firmness to facilitate physician and nursing care during dressing changes, physical examination, bed panning, and patient positioning, while continuously maintaining complete control of individual cell pressures. For example, by activating control module 26 to a bed panning mode, a preselected group of air cells 28 would be automatically deflated a predetermined amount for insertion of the bed pan thereover such that the bed pan surface would be coplanar with that of the mattress assembly, resulting in greater patient comfort with less nursing assistance. By selecting a program temporally patterned, inflation and deflation pressure sequences may be effected so as to provide waves of pressure over the mattress to give a massaging effect or to facilitate circulation. Another button on the control module 26 would effect rapid deflation of all cells for CPR.

Air cells 28 may tend to wrinkle when in partial deflation to conform to a patient's body, possibly producing uncomfortable and possibly decubitus-causing pressure concentrations at the wrinkle sites. To prevent such an occurrence, an air and liquid permeable top sheet 18 is provided which extends closely, without wrinkling, over and about the mattress core 14 and the lateral bolsters 16. The planar surface provided by top sheet 18 further facilitates nursing care by helping to keep dressings in place and preventing the patient's appendages from slipping between the cells with possible injurious results. While mattress covers have been employed in the past for such purposes, they have increased the risk of decubitus ulceration by increasing the pressure on the skin due to their inelastic nature which produces an effect of incomplete draping over prominences of topography on the patient's body. This incomplete draping effect is commonly referred to as hammocking in which, because of incomplete draping of the mattress cover over topographic prominences of the body, the support of the patient's body is accomplished only at the area in contact with the mattress cover, thus concentrating the patient's entire weight on only a small fraction of the surface of the patient's body. Such incomplete draping or hammocking concentrates force on the prominence in excess of the typically allowable 32 mm Hg. pressure, while concurrently producing commensurately increased shear forces due both to the force concentration from incomplete draping per se and from the asymmetric draping that induces a resultant tension parallel to the mattress/skin surface. Many of the mattress covers or top sheets heretofore in use also themselves wrinkle, which again creates pressure concentrations at the wrinkle sites and thus necessitates additional nursing care to straighten the cover which, on occasion, can itself result in a tearing of ulcerated skin. In addition such mattress covers tend to hold moisture and contaminants against the skin, causing maceration and thereby further increasing the risk of decubitus ulceration and infection.

The top sheet 18 of the present inVention consists preferably of a knitted fiber blend of Lycra spandex elastomers, nylon and polypropylene. The Lycra spandex elastomer fibers provide resistance in overall top sheet modulus control and comprise approximately 5–30% of the total fiber content with about 20% being preferred. The nylon fibers comprise about 40% of the blend and are utilized for their friction-reducing characteristics, while the polypropylene induces a water wicking (transport) effect beyond that of nylon to remove perspirated or other moisture outwardly within the sheet and away from the skin surface where it is evaporated by the air flow through cells 28 and parallel to the mattress/skin surface through the open knit of top sheet 18.

The fine knit top sheet 18, in addition to its water wicking characteristics, has a low coefficient of friction and slides more easily over the patient's skin without pulling the skin surface and inducing the considerable shear forces typical of traditional cotton or cotton/-polyester sheets. The addition to the yarn of the top sheet of fibers of fluorocarbon (such as Teflon by Du-Pont) or other similar polymer having a lower coefficient of friction with skin or clothing than that of nylon or the addition of surface treatment of the yarn of the top sheet or treatment of the finished top sheet with silicone, or other inert tissue compatible lubricant, may be employed to further reduce skin shear forces in critical circumstances. Further, unlike cotton or cotton polyester sheets and the largely unyielding laminated woven nylon/Teflon film top sheets and polyester top sheets employed in the prior art, such as Gore Tex, top sheet 18 with its knitted Lycra blend, will stretch and conform to bony protuberances without buildup of contact pressure by minimizing the hammocking or drape-tension effect and also will not wrinkle. The low hysteresis and stress decay of the Lycra fabrics allow the top sheet instantly to recover from stretch without sagging or wrinkling, even after being stretched for protracted periods of time. Unlike the top sheets employed in the prior art, sheet 18 allows liquid spills, exudate and other contaminants to pass therethrough away from the patient onto or between the cells of the mattress where they can be easily cleaned.

In use, the mattress assembly 10 replaces or rests on top of the mattresses currently employed on standard hospital bed frames and on residential beds to comfortably support a person resting thereon at skin contact pressures below 32 mm Hg. By selectively regulating the feed back control pressure within individual supporting air cells and/or groups of cells by means of control module 26, the desired skin contact pressure can be automatically maintained over a wide range of body positions and position changes on the mattress core, whereas without such control position changes could otherwise cause injurious elevation of skin contact pressures, and physician and nursing care is facilitated. In addition, the skin is maintained in a properly hydrated condition by the specifically tailored, continuous flow of air passing to the skin through cells 28 and top sheet 18 so as to prevent skin maceration. Perspiration and other moisture is wicked away from the skin by top sheet 18 and evaporated by the air flowing therethrough. For more severe moisture situations, the temperature module 50 can be employed to elevate the temperature of the air and speed evaporation. Liquids pass through the top sheet 18 and are thereby removed from contact with the patient immediately. As a person moves or is moved on the mattress assembly, sheet 18 stretches to conform to the body without wrinkling or hammocking to maintain the desired low contact pressure and reduce shear forces on the skin. To clean the top sheet or mattress core, the surfaces thereof can easily be wiped clean. Alternatively, the top sheet and/or mattress core can be disposed of, or laundered and disinfected or sterilized.

In the preferred embodiment of the invention, the valve connector stems 46 secured to ends 28' of air cells 28 are readily detachable from the air valves 22 disposed in one or both of the lateral bolsters 16. Accordingly, when it would otherwise be necessary to replace, disinfect or sterilize the assembly due to prolonged usage by a single person or a change of patients, the valves 22 can be detached from the connector stems 46 and the mattress core 14 and top sheet 18 gathered in the lower fluid impermeable liner 20 for disposal or cleaning as described above. Replacement merely requires putting a new lower liner over the support base 12 and lateral bolsters 16, disposing a new mattress core 14 on the liner and securing the valve stem connectors carried by the core to the air valves 22 in the lateral foam bolster 16. Because the aligned grommets 29 of the lower liner 20 make a sealing connection to the valve connector stems 46 even when the stems 46 themselves have been detached from the valves 22, liquid or solid contaminants on the cells 28 or in the liner 20 are kept isolated from the interior of the valves 22, air line 47 and air source 24, thus obviating the need for extensive cleaning of the entire mattress system and bed frame when contamination occurs. Contaminants are contained with the sealingly assembled liner 20 and cells 28 for disposal or cleaning or laundering and disinfection or sterilization.

Figure 7:
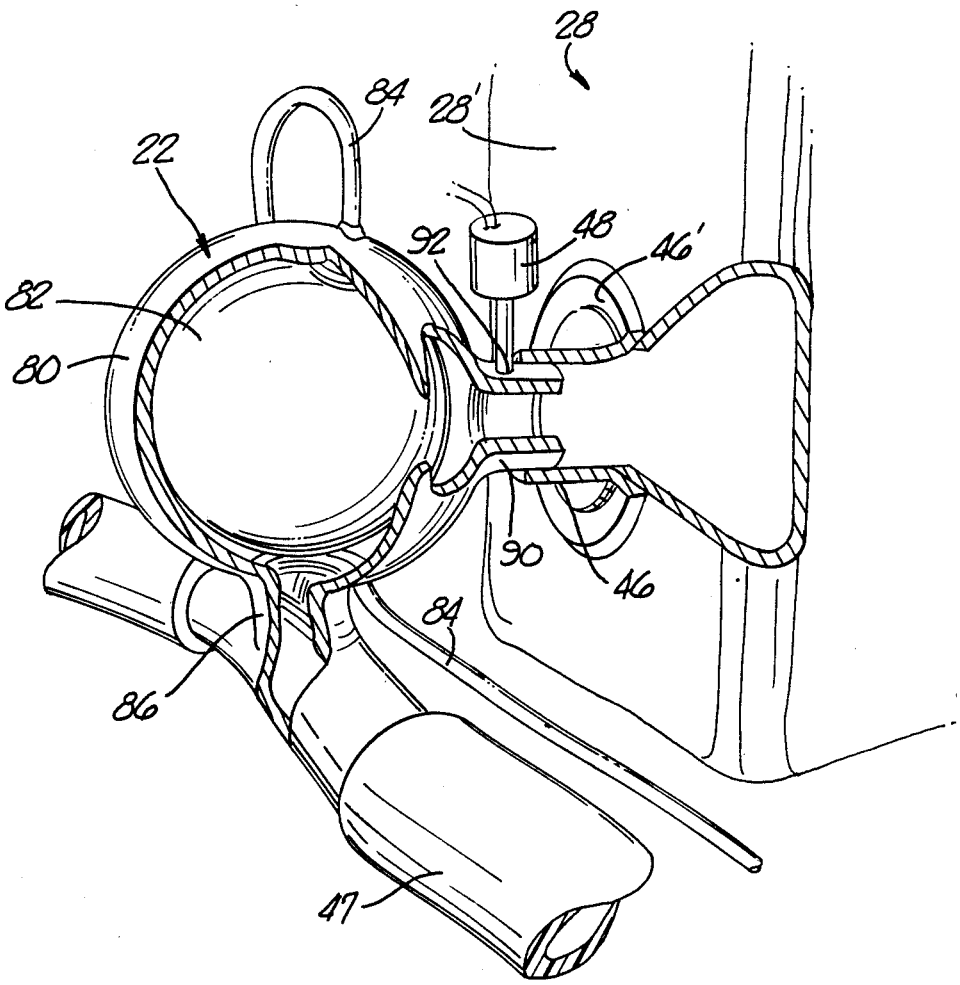
FIG. 7 is a perspective view of one of the air cell control valve in FIG. 2 and the air lines associated therewith.

While valves 22 could be of any number of suitable types and configurations to provide the necessary controlled air flow to air cells 28, FIG. 7 illustrates an embodiment of an inexpensive and quiet valve for such purpose. As seen therein, valves 22, each comprise a rigid outer spherical body portion 80, preferably constructed of a suitable plastic material and an inner inflatable sphere 82 disposed within body portion 80. Inflatable sphere 82 could be constructed of a rubber or an elastomeric polymer, and is inflatable by means of a line 84 extending through the outer body portion 80 and communicates with the interior of inflatable sphere 82. Line 84 communicates with either with air pump 24 or, if necessary, with a secondary air pump (not shown) for providing a sufficiently high pressure air flow to inner sphere 82 to effect inflation thereof. The outer body portion 80 of valve 22 defines an inlet 86 which communicates with the main air line 47 for providing controlled air flow from pump 24 to valves 22. Inlet 86 is preferably in the form a T-fitting so as to not only provide communication between the valve 22 and the main air line 47, but also to physically couple the valve to the main air line. Valve body portion 80 also defines a tubular air outlet 90 which is secured in a press fit within the valve stem 46 which in turn communicates with the interior of the air cell as above described. A port 92 can be provided in outlet 90 for pressure transducer 48 for feed back control of the air sphere 82 inflation. Thus air flow is supplied from air pump 24 to the cells 28 through valves 22 which serially communicate with the main air line 47. By selective inflation of the inner spheres 82 in valves 22, by means of air lines 84, air flow through the valves 22 can be occluded, as desired, as the inflation of spheres 82 will effectively block air flow from the inlet 86 to the outlet 90 of the body portion 80 of the valve. The main air line 47 and the individual air lines 84 would be collectively gathered and, with valves 22, be disposed within one of the lateral side bolsters 16.

In an alternate embodiment of the invention, the individual cells 28 of the mattress core 14 could be partially filled with a foam or other material to provide a cushion for the person resting thereon in the event of a power failure which would interrupt the air flow into the cells and result in a deflation of the cells if an auxiliary power source were not available. A battery powered auxiliary pump could, of course, be provided as a backup for air pump 24 in the event of such failure which would then obviate the need for the additional foam support within the cells. These alternate embodiments would allow for patient transport as well.

Various changes and modifications can be made in carrying out the present invention without departing from the spirit and scope thereof. Insofar as these changes and modifications are within the purview of the appended claims, they are to be considered as part of the present invention.

We claim:

1. A mattress assembly for the treatment and prevention decubitus ulcers and for the treatment of other conditions of the skin and/or underlying tissue, said assembly comprising: a mattress core defining a plurality of discrete, air permeable air cells; a pair of lateral bolsters disposed adjacent opposite sides of said mattress core; a top sheet disposed over said core and said bolsters for defining a planar support surface for a person resting thereon, said sheet being formed of a blend of elastomeric and water wicking fibers to render said sheet air and liquid permeable, highly elastic, of low friction, and water wicking so as to conform readily to the irregularities in the topography of the body of a person resting thereon without wrinkling, and draw moisture away from the skin; air supply means for providing air flow to and through said cells and said sheet to inflate said cells for supporting a person thereon and maintaining the skin of a person thereon in a properly hydrated condition; and means for controlling the air pressure within said cells to maintain the contact pressure of the mattress assembly against the skin of a person thereon at a desired level.

2. The assembly of claim 1 including a plurality of air impervious multi-directional grids differentially disposed on said cells to selectively restrict the passage of air through said cells to selected areas of said top sheet corresponding with the sites which will be in contact with the skin of the person resting thereon thereby reducing the necessary capacity of said air supply means and increasing the tensile strength of said cells.

3. The assembly as in claims 1 or 2 including a liquid impervious liner disposed below said core and between said core and said bolsters for containment of liquids and contaminants and for gathering and disposal of said core and top sheet and any contaminants thereon.

4. The assembly as in claims 1 or 2 including a segmented base support defining a plurality of pivotally joined sections, said liner being disposed on said base below said core and said bolsters being affixed to said base such that said base and said bolsters define a housing for said core.

5. The assembly as in claims 1 or 2 including a sheet of flexible material secured to and extending between said bolsters, said sheet being disposed below said liner.

6. The assembly as in claims 1 or 2 wherein said cells are constructed of woven polyester fabric.

7. The assembly as in claims 1 or 2 wherein said cells are constructed of a spun-bonded, non-woven polyolefin material.

8. The mattress assembly as in claims 1 or 2 wherein said cells are constructed of a woven nylon fabric.

9. The mattress assembly as in claims 1 or 2 wherein said cells are constructed of a material which is sufficiently dense and/or hydrophobic to render said cells aqueous liquid impermeable.

10. The assembly of claim 2 wherein said grids are comprised of a plurality of differently spaced lines defining patterns of varying density to selectively restrict the flow of air therethrough.

11. The mattress assembly of claim 2 wherein said grids are comprised of a plurality of differently spaced dots defining patterns of varying density to selectively restrict the flow of air therethrough.

12. The mattress assembly of claim 2 wherein said grids are comprised of a plurality of radially extending lines and superimposed curvalinear lines disposed thereover, defining patterns of varying density to selectively restrict the flow of air therethrough.

13. The mattress assembly as in claims 2, 10, 11, or 12, wherein said grids are formed of a thermoplastic elastomer, a thermoset elastomer, a low modulus thermoplastic polymer, or a blend of one or more thereof.

14. The assembly as in claim 1 or 2 wherein said controlling means comprises a plurality of dedicated valve members mounted within one of said bolsters and serially communicating with said air supply means, each of said valve members being detachably communicated with one of said air cells, thereby providing selective pressure regulation for individual air cells or selective groups of air cells such that the desired contact pressure between the mattress assembly and the skin of a person resting thereon can be continuously maintained and regulated.

15. The mattress assembly of claim 14 including a plurality of pressure sensors for monitoring the air pressure within each of said air cells defined by said mattress core.

16. The mattress assembly as in claims 1 or 2, including a programmed control module operatively connected between said control means and said air supply means for providing preselected inflation and deflation pressures for individual air cells or selected groups of cells to facilitate physician and nursing care while continuously maintaining control of individual air cell pressures.

17. The assembly of claims 1 or 2 wherein said blend of fibers include fluorocarbon fibers.

18. The assembly of claims 1 or 2 wherein said fibers are treated with silicone.

19. A mattress assembly for the treatment and prevention of decubitus ulcers and for the treatment of other conditions of the skin and/or underlying tissue, said assembly comprising: a mattress core constructed of a spun-bonded, non-woven polyolefin material and defining a plurality of discreet, air permeable air cells; a pair of lateral bolsters disposed adjacent the sides of said core; spacing means secured to and extending between said bolsters below said core; a top sheet disposed over said core and said bolsters for defining a planar support surface for a person resting thereon, said sheet being formed of a blend of elastomeric and water wicking fibers to render said sheet air and liquid permeable, highly elastic, of low friction, and water wicking; a plurality of air impervious multi-directional grids differentially disposed on said air cells to selectively restrict the passage of air through said cells to selected areas of said top sheet; a liquid impervious liner disposed below said core and between said core and said bolsters for gathering and disposal of said core and top sheet and any contaminants thereon; air supply means for providing air flow to and through said cells and said top sheet to inflate said cells for supporting a person thereon and maintaining the skin of a person thereon in a properly hydrated condition; and means for controlling the air pressure within said cells to maintain the contact pressure of the mattress assembly against the skin of a person thereon at a desired level.

20. A mattress assembly for the treatment and prevention of decubitus ulcers and for the treatment of other conditions of the skin and/or underlying tissue, said assembly comprising: a mattress core constructed of a woven material and defining a plurality of discreet, air permeable air cells; a pair of lateral bolsters disposed adjacent the sides of said core; spacing means secured to and extending between said bolsters below said core; a top sheet disposed over said core and said bolsters for defining a planar support surface for a person resting thereon, said sheet being formed of a blend of elastomeric and water wicking fibers to render said sheet air and liquid permeable, a highly elastic, of low friction, and water wicking; a plurality of air impervious multidirectional grids differentially disposed on said air cells to selectively restrict the passage of air through said cells to selected areas of said top sheet; a liquid impervious liner disposed below said core and between said core and said bolsters for gathering and disposal of said core and top sheet and any contaminants thereon; air supply means for providing air flow to and through said cells and said top sheet to inflate said cells for supporting a person thereon and maintaining the skin of a person thereon in a properly hydrated condition; and means for controlling the air pressure within said cells to maintain the contact pressure of the mattress assembly against the skin of a person thereon at a desired level.

21. The mattress assembly as in claims 19 or 20 wherein said cells are constructed of a material which is sufficiently dense and/or hydrophobic to render said cells aqueous liquid impermeable.

22. The mattress assembly of claim 20 wherein said woven material is a polyester fabric.

23. The mattress assembly of claim 20 wherein said woven material is nylon.

24. A mattress assembly for the treatment and prevention of decubitus ulcers and for the treatment of other conditions of the skin and/or underlying tissue, said assembly comprising: a mattress core defining a plurality of discreet air cells, said core being constructed of an air permeable material which is sufficiently dense and/or hydrophobic to render said cells aqueous liquid impermeable; a pair of lateral bolsters disposed adjacent the sides of said core; spacing means secured to and extending between said bolsters below said core; a top sheet disposed over said core and said bolsters for defining a planar support surface for a person resting thereon, said sheet being formed of a blend of elastomeric and water wicking fibers to render said sheet air and liquid permeable, highly elastic, of low friction, and water wicking; a plurality of air impervious multidirectional grids differentially disposed on said air cells to selectivity restrict the passage of air through said cells to selected areas of said top sheet; a liquid impervious liner disposed below said core and between said core and said bolsters for supporting a person thereon and maintaining the skin of a person thereon in a properly hydrated condition; and means for controlling the air pressure within said cells to maintain the contact pressure of the mattress assembly against the skin of a person thereon at a desired level.

25. The mattress assembly as in claims 19, 20, 22, 23 or 24 wherein said spacing means comprises a rigid segmented support base defining a plurality of pivotally joined sections, said liner being disposed on said base below said core and said bolsters being affixed to said base so as to define with said base a housing for said core.

26. The mattress assembly as in claims 19, 20, or 24 wherein said grids are comprised of a plurality of differently spaced lines defining patterns of varying density to selectively restrict the flow of air therethrough.

27. The mattress assembly as in claims 19, 20, or 24 wherein said grids are comprised of a plurality of radially extending lines and superimposed curvalinear lines disposed thereover, defining patterns of varying density to selectively restrict the flow of air therethrough.

28. The mattress assembly as in claims 19, 20, or 24 wherein said grids are comprised of a plurality of differently spaced dots defining patterns of varying density to selectively restrict the flow of air therethrough.

29. The mattress assembly as in claims 26, 27, or 28 wherein said grids are formed of a thermoplastic elastomer, a thermoset elastomer, a low modulus thermoplastic polymer, or a blend of one or more thereof.

30. The mattress assembly as in claims 19, 20, or 24 wherein said grids define patterns on said cells, said patterns being of varying density from cell to cell to tailor the air flow through said cells to said selected areas.

31. The mattress assembly as in claims 19, 20 or 24 wherein said controlling means comprises a plurality of dedicated valve members mounted within one of said bolsters and serially communicating with said air supply means, each of said valve members being detachably communicated with one of said air cells, thereby providing selective pressure regulation for individual air cells or selective groups of air cells such that the desired contact pressure between the mattress assembly and the skin of a person resting thereon can be continuously maintained and regulated.

32. The mattress assembly of claim 31 including a plurality of pressure sensors disposed in a corresponding plurality of said valves for monitoring the air pressures within the cells communicating with said valves.

33. The mattress assembly as in claims 19, 20, or 24 including a plurality of pressure sensors for monitoring the air pressure within selected air cells defined by said mattress core.

34. The mattress assembly as in claims 19, 20, 24, 30 or 31 including a programmed control module operatively connected between said control means and said air supply means for providing preselected inflation and deflation pressures for individual air cells or selected groups of cells to facilitate physician and nursing care while continuously maintaining control of individual air cell pressures.

35. The assembly as in claims 1, 2, 19, 20 or 24 wherein said top sheet comprises a knitted blend of said elastomeric and water wicking fibers.

36. The assembly as in claims 1, 2, 19, 20 or 24 wherein said elastomeric fibers in said top sheet include Lycra fibers.

37. The assembly as in claims 1, 2, 19, 20 or 24 wherein said elastomeric fibers in said top sheet comprise Lycra fibers and nylon fibers and said water wicking fibers comprise polypropylene fibers.

38. The assembly of claim 37 wherein said Lycra elastomeric fibers comprise 5–30% of the total fiber content of said sheet and said nylon fibers comprise about 40% thereof.

39. The assembly of claims 19, 20 or 24 wherein said elastomeric fibers in said top sheet comprise Lycra fibers and nylon fibers, said water wicking fibers comprise polypropylene fibers, said elastomeric fibers comprise 5–30% of the total fiber content of said sheet, and said nylon fibers comprise about 40% thereof.

40. An air loss mattress assembly for the treatment and prevention of decubitus ulcers and for the prevention of other conditions of the skin of the type having an air permeable, mattress core, the improvement comprising a top sheet disposed over said core for defining a planar surface for a person resting thereon, said sheet being formed of a blend of elastomeric and water wicking fibers to render said sheet air and liquid permeable, highly elastic, of low friction, and water wicking; so as to conform readily to irregularities in the topography of the body of a person thereon without wrinkling, to minimize shear forces against the skin, draw moisture from the skin and to allow liquid spills and exudate to pass therethrough.

41. The improvement of claim 20 wherein said fibers in said top sheet comprises a blend of Lycra elastomeric fibers, nylon fibers, and polypropylene fibers.

42. The improvement of claim 41 wherein said Lycra elastomeric fibers comprise about 5–30% of the total fiber content of said sheet and said nylon fibers comprise about 40% thereof.

43. The improvement of claim 40 wherein said top sheet is comprised of a knitted fiber blend including fluorocarbon fibers.

44. The improvement of claims 40 wherein said top sheet is comprised of fibers treated with silicone.

45. The top sheet of claim 40 wherein said sheet comprises a knitted blend of said elastomeric and water wicking fibers.

* * * * *